United States Patent [19]

Hayashi et al.

[11] 3,972,260

[45] Aug. 3, 1976

[54] MULTIPLE TOOL HOLDING PUNCHING APPARATUS

[75] Inventors: Yoshiyuki Hayashi, Isehara; Hideo Morita, Hatano, both of Japan

[73] Assignee: Amada Company Limited, Isehara, Japan

[22] Filed: Mar. 7, 1975

[21] Appl. No.: 556,408

[30] Foreign Application Priority Data

Dec. 26, 1974 Japan ..... 49-156878

[52] U.S. Cl. ..... 83/549; 83/562

[51] Int. Cl.[2] ..... B26F 1/04

[58] Field of Search ..... 83/549, 561, 562, 551, 83/550

[56] References Cited

UNITED STATES PATENTS

| | | | |
|---|---|---|---|
| 1,728,475 | 9/1929 | Cavill | 83/549 X |
| 3,895,550 | 7/1975 | Daniels | 83/549 X |

*Primary Examiner*—Willie G. Abercrombie
*Attorney, Agent, or Firm*—Wigman & Cohen

[57] ABSTRACT

This disclosure relates to a punching apparatus for perforating sheet metal or the like, comprising a tool holder having a body portion which includes upper and lower arms extending horizontally from the body portion in vertically spaced alignment from one another to form a throat into which sheet material to be punched may be positioned. Each of the upper and lower arms includes a plurality of spaced bores of different diameters, each of which is vertically aligned with a corresponding bore in the opposite arm. The bores in the upper arm are adapted to receive a plurality of punches of different diameters, while the lower bores are adapted to receive a plurality of dies of different diameters for operatively receiving a corresponding punch during a punching operation. The tool holder is slidably mounted in a work table disposed beneath a vertically movable ram of the apparatus, whereby corresponding ones of punches and dies may be selectively operatively positioned beneath the ram to punch holes of varying diameters.

2 Claims, 3 Drawing Figures

3
13S
13Sf
13L
7
5
13Lf
23S
23L
25S
25L
21S
21L
17S
17L
11
31
II
II
M
19S
9
15S
51
39
27L
29
15Ss
1
27S
15L
33
15Ls
19L
49
41S
35
41

III
47
45
35
37
51
49
I
39
31
27L
19S
15S
11
1
29
27S
15L
19L
41
43
I
III 11
15
9
29
49
47
43
1
45
37
51
39
33
35
41S
41

MULTIPLE TOOL HOLDING PUNCHING APPARATUS

BACKGROUND OF THE INVENTION

1. Field of the Invention

The present invention relates generally to a punching apparatus to be incorporated into presses for punching sheet metals and other sheet materials and pertains more particularly to a multiple tool holding punching apparatus which can hold various tools, both large and small.

2. Description of the Prior Art

Punching holes in sheet metals and other sheet materials has long been carried out by presses by means of a tool holder which holds a punch or upper tool and a die or lower tool and is mounted on the table of a press beneath the ram thereof. Such a tool holder can hold a certain range of punches and dies for punching holes varying in diameter, since the punches and dies for a certain range of holes are so designed that their body portions to be held by the tool holder are all the same in diameter even if their punching bits or edges are different in size and shape to punch various holes. However, since punches and dies for punching larger holes have to be made larger in diameter, it has been customary to provide two ranges of punches and dies, one of which is used for punching smaller holes varying for example from 1/32 to 1¼ inches in diameter and the other of which is for punching larger holes varying for example from 1¼ to 3½ inches in diameter, and the tool holder has been designed to carry only one of these set ranges of tools.

Accordingly, it has been a serious disadvantage with the conventional punching apparatus that two tool holders, a small one and a larger one, are required to punch a wide range of holes which are both small and large in size. Therefore, when it is desired to punch holes of the larger range of sizes, it is necessary to remove the whole tool holder from the punching machine and replace it with another tool holder which is adapted to hold the larger tools. This job has been very troublesome and time-consuming and also dangerous since the tool holder is quite heavy and is to be mounted on the high table of the press.

Although there have been some means to overcome the above-mentioned disadvantages, they have been costly, and also it has been very often required to make a wholly special machine in order to incorporate such a means.

SUMMARY OF THE INVENTION

It is the general object of the present invention to provide an improved punching apparatus which can be efficiently used to punch holes of a wide range of sizes in sheet materials.

It is a specific object of the present invention to provide a punching apparatus in which the tool holder can accommodate multiple size ranges of punches and dies without being replaced.

It is another object of the present invention to provide a punching apparatus in which a desireable punch and die set can be easily placed at the punching position.

It is a further object of the present invention to provide a punching apparatus in which punches and dies can be easily replaced with others for desired sizes and shapes of holes to be punched.

It is a still further object of the present invention to provide an improved punching apparatus which is economical to manufacture and can be used with conventional presses.

Other and further objects and advantages of the present invention will be apparent from the following description and accompanying drawings, which, by way of illustration, show a preferred embodiment of the present invention and the principle thereof.

DESCRIPTION OF THE PREFERRED EMBODIMENTS

Figure 1:
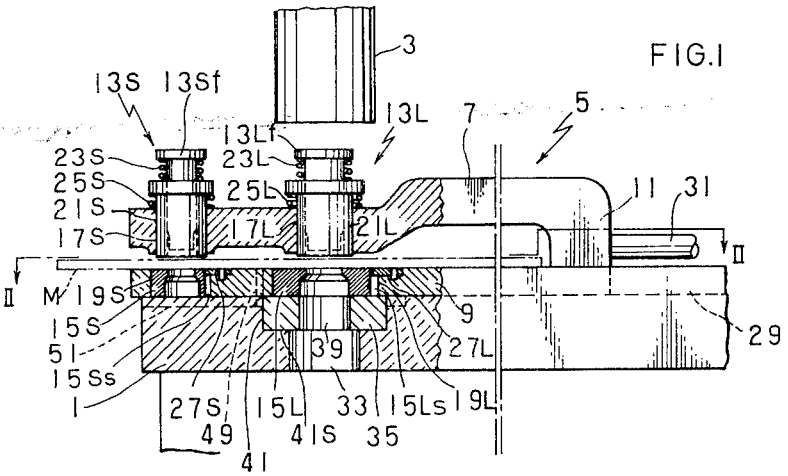
FIG. 1 is a side elevational view of a multiple tool holding punching apparatus according to the present invention which is shown in section on the plane of the line I—I in FIG. 2.

Referring now to the accompanying drawings, the multiple tool holding punching apparatus according to the present invention is installed on the table 1 of a press (not shown) which has a vertically movable ram 3.

The central member of the multiple tool holding punching apparatus is a tool holder generally designated by the numeral 5 which is of a generally C-shaped construction and has an upper arm 7 and a lower arm 9 both of which horizontally extend from the upright body portion 11 of the tool holder 5 to form a throat or opening into which the sheet material M to be perforated is placed. The construction of the tool holder 5 is identical to conventional ones but differs distinctively from them in that it is provided at its upper and lower arms 7 and 9 with two pair of tools which may be all the same in construction but are different from each other in size or diameter.

In the preferred embodiments, a smaller punch 13S and a smaller die 15S are provided at the outermost free ends of the upper and lower arms 7 and 9, respectively, and a larger punch 13L and a larger die 15L are provided next to the smaller punch 13S and die 15S on the upper and lower arms 7 and 9, respectively. The punches 13S and 13L are held in a conventional manner in vertical punch holding bores 17S and 17L, respectively, which are formed through the upper arm 7 so that their vertical axial centers may align with the vertical longitudinal central plane of the upper arm 7. likewise, the dies 15S and 15L are held in vertical die holding bores 19S and 19L, respectively, which are formed through the lower arm 9 so that their vertical centers may align with the vertical longitudinal central plane of the lower arm 9. Of course, the axial centers of the die holding bores 19S and 19L have to align or coincide with the axial centers of the punch holding bores 17S and 17L, respectively. Also, the smaller punch 13S and die 15S have smaller punching bits or edges to punch smaller holes in the sheet material M, and the larger punch 13L and die 15L have larger punching bits or edges to make larger holes.

The punch and die sets may be of any suitable conventional construction, and in the preferred embodiments the sets of the smaller punch 13S and die 15S and that of the larger punch 13L and die 15L are all the same in construction and function and they are different from each other only in size or diameter. The two sets of the punches 13S and 13L and the dies 15S and 15L in the preferred embodiments will be described commonly as a single set, although each element will be accompanied by two reference numbers, a preceding or low one of which designates the element of the smaller punch 13S or die 15S.

As shown in FIG. 1, the punch 13S, 13L is provided at its top portion with a flange 13S*f*, 13L*f* and is held in the punch holding bore 17S, 17L by means of a guide sleeve 21S, 21L having a flange 21S*f*, 21L*f* at its top end. The punch 13S, 13L is vertically movable in the guide sleeve 21S, 21L and is usually upwardly biased by a helical stripping spring 23S, 23L which surrounds the upper portion of the punch 13S, 13L and carries the flange 13S*f*, 13L*f* thereof on the top of the guide sleeve 21S, 21L. The guide sleeve 21S, 21L is also vertically movable in the punch holding bore 17S, 17L and it is also surrounded by a helical lifter spring 25S, 25L to be usually upwardly biased at the raised position as shown in FIG. 1. On the other hand, the die 15S, 15L is directly held in the die holding bore 19S, 19L in any conventional manner. For the purpose of orienting the die 15S, 15L, a vertical guide slot 15S*s*, 15L*s* is formed at the periphery of the die 15S, 15L, and a guide key 27S, 27L is horizontally arranged at the periphery of the die holding bore 19S, 19L to engage the guide slot 15S*s*, 15L*s*. Thus, when the punch 13S, 13L is struck by the ram 3 of the press, it compresses first the stripping spring 23S, 23L through its flange 13S*f*, 13L*f* and then the lifter spring 25S, 25L through the guide sleeve 21S, 21L and is lowered to punch a hole in the sheet material M in cooperation with the die 15S, 15L. On completion of a punching operation, the stripping spring 23S, 23L strips the punch 13S, 13L from the die 15S, 15L and the sheet material M and then the lifter spring 25S, 25L lifts the guide sleeve 21S, 21L and other elements to keep them raised at their inoperative position as shown in FIG. 1.

In view of the above, it will be understood that the smaller guide sleeve 21S and the smaller die holding bore 19S can hold various smaller punches and dies, respectively, which are equal in outer diameter but have different punching bits or edges for punching various holes varying for example from 1/32 to 1¼ inches in diameter or size, and likewise the larger guide sleeve 21 and the larger die holding bore 19S can hold various larger punches and dies, respectively, which are equal in outer diameter but have various punching bits or edges for punching various holes varying for example from 1¼ to 3½ inches in diameter or size.

Figure 2:
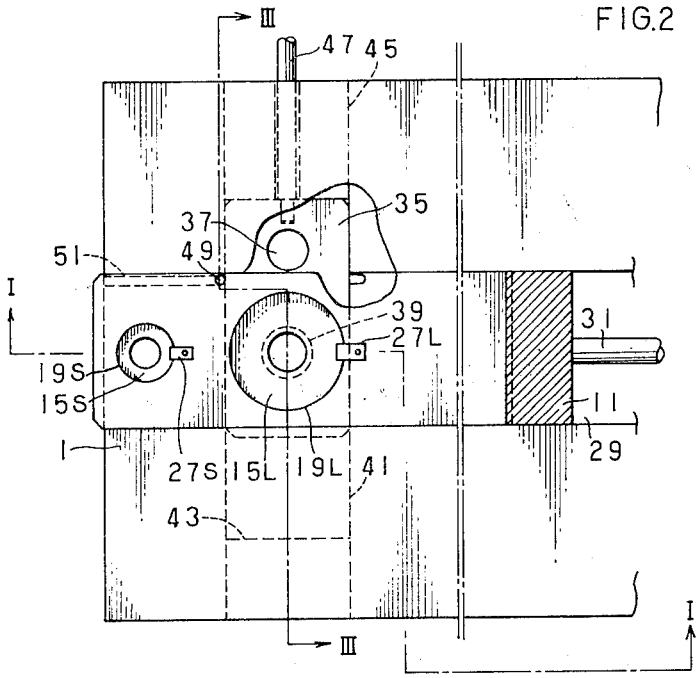
FIG. 2 is a plan view about a horizontal section taken on the plane of the line II—II in FIG. 1, a part of the view being broken away.

It is a feature of the present invention that the tool holder 5 is horizontally slidably mounted in a first slideway 29 which is horizontally formed on the top of the table 1 of the press to extend just beneath the ram 3 of the press from the rear end of the table 1 to the front end thereof; that is from the right-hand end of the table 1 to the left-hand end thereof as viewed in FIGS. 1 and 2. The entire tool holder 5 is so designed as to be moved in the slideway 29 by hand or by a suitable actuating means such as a piston rod 31 which is horizontally connected to the rear body portion 11 of the tool holder 5 and is hydraulically or pneumatically actuated by a piston in a cylinder mounted on the rear of the table 1 of the press. Also, the tool holder 5 can be moved forward to the extent that the large punch 13L and die 15L will extend beyond the forward end of the table 1 of the press so that the smaller and larger dies 15S and 15L can be downwardly detached from the die holding bores 19S and 19L, respectively. The punches 13S and 13L can be upwardly removed from the guide sleeves 21S and 21L, respectively.

As best shown in FIG. 1, a slug discharging bore 33 from which the slugs coming from the punching operations are to be discharged is vertically formed in the slideway 29 to vertically pass through the table 1 just beneath the ram 3 of the press. It will be understood that the slug discharging bore 33 should be so located that its axial center will align with the longitudinal central line of the width of the slideway 29 for the tool holder 5. Thus, the punching operation is carried out by either of the smaller punch 13S and die 15S or the larger punch 13L and die 15L above the slug discharging bore 33 which is located just beneath the ram 3 of the press. Therefore, the place of the slideway 29 above the slug discharging bore 33 and just beneath the ram 3 can be called a punching station. In the drawings, it is shown that the larger punch 13L and die 15L are positioned at the punching station.

Figure 3:
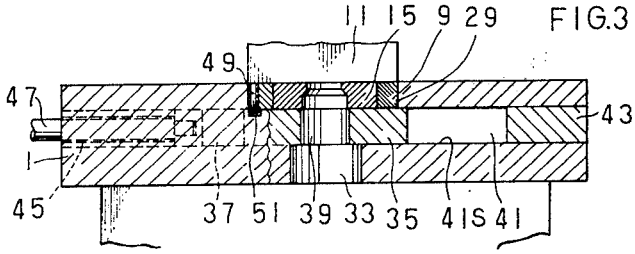
FIG. 3 is a vertical section taken on the plane of the line III—III in FIG. 2.

Both of the smaller die 15S and the larger die 15L are different in outer diameter from each other, and yet they have to be commonly held above the slug discharging bore 33 of a fixed diameter against the punching pressure deriving from the ram 3 of the press. For this purpose, there is provided above the slug discharging bore 33 a die supporter plate 35 which is a horizontally movable elongate plate and is provided with two vertical round holes 37 and 39, from which the slugs coming from the punching operation can be discharged into the slug discharging bore 33. The die supporter plate 33 is designed to be thick and wide enough to support the dies 15S and 15L above the slug discharging bore 33 against the punching pressure, and it supports the dies 15S and 15L on its holes 37 and 39 in a manner such that the centers of the dies 15S and 15L will substantially coincide with those of the holes 37 and 39. In the preferred embodiments, the hole 37 is formed on the left-hand side of the die supporter plate 35 as viewed in FIG. 3 and is small in diameter to enable the die supporter plate 35 to support the smaller die 15S, while the right-hand hole 39 is large in diameter to be used with the larger die 15L and enable the largest slugs made by the larger die 15L to pass therethrough into the slug discharging bore 33. Also, the centers of the smaller and larger holes 37 and 39 are made to align with the horizontally longitudinal central line of the die supporter plate 35 so that each of them will coincide with the center of the die 15S or 15L when positioned above the slug discharging bore 33.

The die supporter plate 35 is horizontally slidably mounted in a second slideway 41 which is formed to horizontally extend below the top of the table 1 and above the slug discharging bore 33 and form a shouldered portion 41S surrounding the slug discharging bore 33. In order to make the top surface of the die supporter plate 35 flush with the top surface of the slideway 29 for the tool holder 5, the slideway 41 for the die supporter plate 35 is formed to be lowered below the slideway 29 by an amount corresponding to the thickness of the die supporter plate 35. Also, the slideway 41 for the die supporter 35 is defined by suitable means such as stop members 43 and 45 so as to define the movement of the die supporter plate 33. Since the die supporter plate 33 is designed to take only two positions to place either of the smaller hole 37 or the larger hole 39 at the punching station above the slug discharging bore 33, the stop members 43 and 45 work to position the smaller hole 37 and the larger hole 39, respectively, at the punching station. When the die supporter plate 35 is brought into contact with the stop member 45 as shown in the drawings, the larger hole 39 is positioned at the punching station above the slug discharging bore 33 to support the larger die 15L against the punching pressure. Likewise, when the die supporter plate 35 contacts the stop member 43, the smaller hole 37 is positioned at the punching station to support the smaller die 15S. The slideway 41 for the die supporter plate 35 may intersect the slideway 29 for the tool holder 5 at any angles, but the two slideways intersect at right angles in the preferred embodiment. The die supporter plate 35 can be slid in the slideway 41 by hand or by any other suitable means such as a piston rod 47 which is actuated by a piston rod and cylinder mounted below the table 1 of the press.

In order to position the tool holder 5 in the slideway 29 so that the smaller punch 13S and die 15S and the larger punch 13L and die 15L may be precisely positioned at the punching station above the slug discharging bore 33, the tool holder 5 is provided at its underside with a positioning member 49 downwardly projecting, and the slideway 29 is formed at its top surface with a guide groove 51 in which the projecting positioning member 49 is moved together with the tool holder 5. When the positioning member 49 is brought into contact with the forward vertical surface of the die supporter plate 35 as shown in FIGS. 1 and 2, the larger punch 13L and die 15L are positioned at the punching station. Also, when the positioning member 49 contacts the inner end of the guide groove 51, the smaller punch 13S and die 15S are positioned at the punching station. The projecting positioning member 49 can travel along the guide groove 51 to the inner end thereof without being prevented by the die supporter plate 35, since previously the die supporter plate 35 has been shifted rightwards as viewed in FIG. 3 so that the smaller hole 37 may be positioned above the slug discharging bore 33 and the projecting positioning member 49 may pass over the piston rod 47.

In view of the above, it will be understood that either of the smaller punch 13S and die 15S and the larger punch 13L and die 15L can be easily positioned at the punching station beneath the ram 3 of the press only by moving the tool holder 5 in either direction along the slideway 29 in order to punch smaller or larger holes in the sheet material M. Also, the punches 13S and 13L and the die 15S and 15L can be easily detached from the tool holder 5 by moving the tool holder 5 forward to make its upper and lower arms 7 and 9 horizontally project from the forward end of the table 1 of the press. The tool holder 5 can be designed to be manually moved in the slideway 29 but it can be also moved hydraulically or pneumatically by the piston rod 31 actuated by a piston and cylinder. Also, in order to support either of the smaller die 15S and the larger die 15L above the slug discharging bore 33 beneath the ram 3 against the punching pressure, it is only necessary to move the die supporter plate 35 in either direction in the slideway 41 by hand or by means of the piston rod 47 hydraulically or pneumatically actuated by a piston and cylinder.

In the above description and the accompanying drawings, the horizontally movable die supporter plate 35 having two holes 37 and 39 for discharging the slugs is provided above the slug discharging bore 33, since the smaller and larger dies 15S and 15L having different diameters have to be held commonly above the slug discharging bore 33 having a fixed diameter. However, it is possible to eliminate the die supporter plate 35 and make the top of the slug discharging bore 33 flush with the slideway 29 for the tool holder 5, if the smaller die 15S is held at its position by means of an adapter which is of a round shape having the same diameter as the larger die 15L and is held in the same manner as the larger die 15L. The adapter for supporting the smaller die 13S can be designed to have at its central portion a shouldered bore into which the smaller die 15S is placed in the same manner as in the die holding bore 19S and also from which bottom the slugs made by the smaller punch 13S and die 15S can be discharged into the slug discharging bore 33. Since the adapter for holding the smaller die 13S is the same in diameter as the larger die 15L, it is held against the punching pressure on the slug discharging bore 33 which is formed to have an upper end flush with the slideway 29 for the tool holder 5. Of course, the larger die 15L can be held on the slug discharging bore 33 in the same way as the adapter for holding the smaller die 15S. In this arrangement, it is only necessary to move the tool holder 5 in the slideway 29 in order to use either of the smaller punch 13S and die 15S and the larger punch 13L and 15L.

Although the preferred embodiment of the present invention has been described and illustrated as being capable of holding only two ranges of tools that are the smaller punch 13S and die 15S and the larger punch 13L and die 15L, the multiple tool holding apparatus according to the present invention can be designed to hold additional ranges of tools as well.

As has been so far described, the multiple tool holding punching apparatus according to the present invention is so designed that it can be installed with both of smaller tools and larger tools which can be used for punching smaller holes and larger holes, respectively. Accordingly, it can be advantageously used to punch various holes of a wide range of sizes in sheet materials.

According to the present invention, in order to punch the smaller or larger range of holes, it is only necessary to move the tool holder 5 in either diirection in the slideway 29 to position either of the smaller punch 13S and die 15S and the larger punch 13L and die 15L at the punching station beneath the ram 3 of the press. The tool holder 5 can be most easily moved in the slideway 29 by means of the piston rod 31 hydraulically or pneumatically actuated. Also, the punches 13S and 13L and the die 15S and 15L can be easily detached from the tool holder 5 to be replaced by others, when the tool holder 5 is moved forward and its upper and lower arms 7 and 9 are projected from the end of the table 1 of the press.

In addition to the above described advantages, the multiple tool holding punching apparatus according to the present invention is of a simple construction which can be economically manufactured, and also it can be easily mounted on any conventional presses and accordingly it does not need any special machines.

Although the preferred forms of the present invention have been illustrated and described, it should be understood that the device is capable of modification by one skilled in the art without departing from the principles of the invention. Accordingly, the scope of the invention is to be limited by the literal interpretation of the claims appended hereto.

We claim:

1. A punching apparatus comprising a work table disposed beneath a vertically movable ram, a tool holder having a body portion and including upper and lower arms each extending substantially horizontally from said body portion in vertically spaced alignment from one another to form a throat into which sheet material to be punched may be positioned, a plurality of upper tool-holding bores extending vertically through said upper arm the vertical axes of which being aligned with a vertical plane extending through the longitudinal axes of said arms, each of said bores being of a different diameter, a plurality of upper tools of different diameters each of which is detachably mounted in one of said bores of corresponding diameter, a plurality of lower tool-holding bores extending vertically through said lower arm and being concentrically aligned with corresponding ones of said upper bores, a plurality of lower tools of different diameters each of which is detachably mounted in one of said lower bores of corresponding diameter for operatively receiving a corresponding upper tool during a punching operation, said work table having a first slideway formed therein extending beneath said ram, said tool holder being slidably mounted in said slideway whereby corresponding ones of said upper and lower tools may be selectively operatively positioned beneath said ram, said work table further including a second slideway extending beneath and in communication with said first slideway, a slug discharging bore opening into said second slideway and extending vertically downwardly therefrom with its axis aligned with the axis of said ram, a lower tool supported member slidably mounted in said second slideway with its upper surface flush with said first slideway, and a plurality of spaced vertical holes of different diameters extending through said tool supporter member and adapted to be vertically aligned with said slug discharging bore.

2. A punching apparatus as defined in claim 1 wherein said first slideway includes means for precisely fixing the position of each of said tools with respect to said ram.

* * * * *